US006421926B1

(12) United States Patent
Cappuccio

(10) Patent No.: US 6,421,926 B1
(45) Date of Patent: Jul. 23, 2002

(54) STRINGLINE GUIDE SYSTEM

(75) Inventor: Louis W. Cappuccio, 16 Mill Run Dr., Hammonton, NJ (US) 08037

(73) Assignee: Louis W. Cappuccio, Hammonton, NJ (US)

( * ) Notice: Subject to any disclaimer, the term of this patent is extended or adjusted under 35 U.S.C. 154(b) by 0 days.

(21) Appl. No.: 09/716,126

(22) Filed: Nov. 10, 2000

(51) Int. Cl.[7] ..... B44D 3/00

(52) U.S. Cl. ..... 33/413; 33/1 LE; 33/1 H; 33/339

(58) Field of Search ..... 33/1 G, 1 H, 1 LE, 33/228, 290, 293, 339, 755, 756, 757, 759, 404, 413, 406, 409

(56) References Cited

U.S. PATENT DOCUMENTS

| | | | | | |
|---|---|---|---|---|---|
| 603,157 | A | * | 4/1898 | Spitzenberg | 33/413 |
| 2,632,954 | A | * | 3/1953 | Lieberman | 33/1 H |
| 3,104,468 | A | * | 9/1963 | Sarles | 33/406 |
| 3,250,009 | A | * | 5/1966 | Oseka | 33/404 |
| 4,101,088 | A | * | 7/1978 | Stauth | 242/85 |
| 4,231,156 | A | | 11/1980 | Cooper | 33/1 LE |
| 4,309,120 | A | | 1/1982 | Werthmann | 403/18 |
| 5,035,384 | A | | 7/1991 | Werthmann | 248/74.2 |
| 5,492,294 | A | | 2/1996 | Haeussler | 248/229.1 |
| 5,621,976 | A | * | 4/1997 | Ochsenbine | 33/1 LE |
| 5,878,505 | A | * | 3/1999 | Scarpellini | 33/1 H |

* cited by examiner

*Primary Examiner*—Diego Gutierrez
*Assistant Examiner*—Mirellys Jagan
(74) *Attorney, Agent, or Firm*—Stuart M. Goldstein

(57) ABSTRACT

The present invention relates to a stringline guide system for setting required vertical and horizontal distances, while laying out and preparing a road, sidewalk, driveway or similar construction surface. The system is adapted for use with string, twine, wire, fishing line, tubing, or other similarly and commonly used construction type lines. Circular collars are positioned on the marking rods or stakes of the system. The collars have internal and external surfaces and are mounted on the rods or stakes at and through their interior surfaces. The collars are adjustably mounted on the rods by wing nuts extending through the collars to the rods. The collars have dual grooves which substantially encircle the exterior surface of the collar. The grooves are configured to accept and maintain the stringline, thus securing the lines in position on the collars. Stringlines with external diameters which approximate the width of the grooves can be compressed within the grooves for added securing ability. In an alternative embodiment, the collar can include transverse grooves which interconnect the dual grooves allowing the line to extend from one groove to another. The stringline system permits easy and ready adjustment of individual collars, which assists in the setting of proper distances.

6 Claims, 2 Drawing Sheets

STRINGLINE GUIDE SYSTEM

BACKGROUND OF THE INVENTION

When preparing to construct a road, sidewalk, driveway, path, or similar surface, the engineer, contractor, or surveyor is routinely faced with the problem of ensuring that the surface is properly leveled and otherwise appropriately configured. Often a stringline is used as a guide to set the proper horizontal and vertical distances in relation to the surface being constructed. Stakes or rods are planted in the ground adjacent to the construction surface. Brackets or clamp guides are connected to the rods. A stringline is then run between the brackets or clamps, along the periphery of the surfaces, the stringlines set at the proper vertical and horizontal distances above the surfaces. The brackets or clamps must be adjusted independently to ensure for proper setting of the stringline. Examples of such systems are found in U.S. Pat. Nos. 4,231,156, 5,035,384, and 5,492,294.

However, the clamps or brackets which are disclosed in these prior systems have a number of drawbacks. For instance, since many clamps or brackets are often needed when there is a large roadway surface to be laid out, a stringline guide device, as is shown in U.S. Pat. No. 4,231,156, is quite impractical in use. First, such a device is overly complex in configuration and thus cumbersome to adjust, especially given the number of devices which require adjustment. Also, guide devices of this configuration are more difficult and expensive to manufacture. Other guide devices, shown for instance in U.S. Pat. Nos. 5,035,384 and 5,492,294, have these similar drawbacks and also are not adapted to readily and directly accept and maintain a stringline in position.

SUMMARY OF THE INVENTION

It is thus the object of the present invention to overcome the limitations and disadvantages of prior stringline guide systems.

It is an object of the present invention to provide a stringline guide system which is simple in configuration and use.

It is a further object of the present invention to provide a stringline guide system which is easily and quickly adjustable on the rod or stake used in the system.

It is still another object of the present invention to provide a stringline guide system which directly holds and maintains the line and thus allows easy and quick adjustment of the line on the rod.

It is a further object of the present invention to provide a stringline guide system which securely holds and maintains a line by the use of a vertically and horizontally adjustable collar with grooves which can compress the line.

It is still further object of the present invention to provide a stringline guide system which are all times securely holds all types of lines, including string, twine, wire, fishing line, tubing and other normally used construction lines.

It is another object of the present invention to provide a stringline guide system which is simple and relatively inexpensive to manufacture.

The present invention relates to a stringline guide system for setting required vertical and horizontal distances, while laying out and preparing a road, sidewalk, driveway or similar construction surface. The system is adapted for use with string, twine, wire, fishing line, tubing, a or other similarly and commonly used construction type lines. Circular collars are positioned on the marking rods or stakes of the system. The collars have internal and external surfaces and are mounted on the rods or stakes at and through their interior surfaces. The collars are adjustably mounted on the rods by wing nuts extending through the collars to the rods. The collars have dual grooves which substantially encircle the exterior surface of the collar. The grooves are configured to accept and maintain the stringline, thus securing the lines in position on the collars. Stringlines with external diameters which approximate the width of the grooves can be compressed within the grooves for added securing ability. In an alternative embodiment, the collar can include transverse grooves which interconnect the dual grooves, allowing the line to extend from one groove to another. The stringline system permits easy and ready adjustment of individual collars, which assists in the setting of proper distances.

The novel features which are considered as characteristic of the invention are set forth in particular in the appended claims. The string line guide system itself, however, both as to its design, construction, and use, together with additional features and advantages thereof, are best understood upon review of the following detailed description with reference to the accompanying drawings.

DETAILED DESCRIPTION OF THE INVENTION

Figure 1:
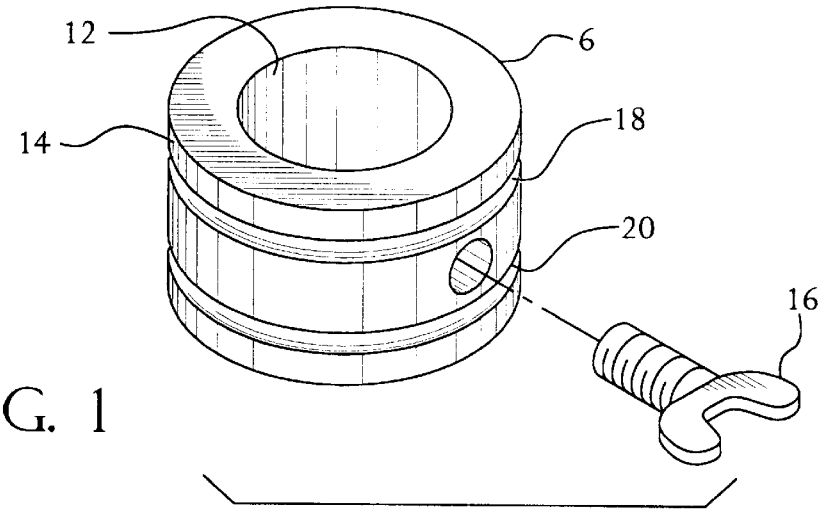
FIG. 1 is a perspective view of the collar and wing nut of the present invention.
Figure 2:
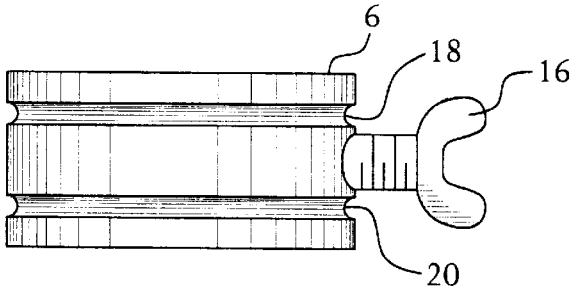
FIG. 2 is a side view of the collar of the present invention, with wing nut installed.
Figure 2A:
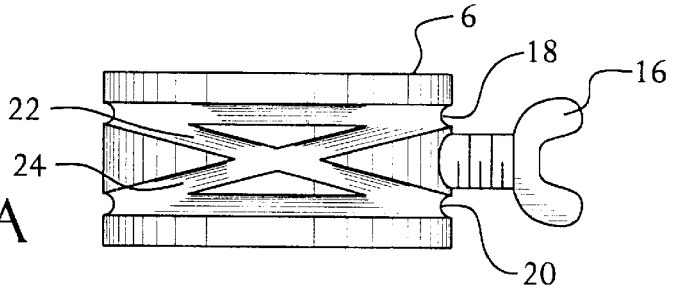
FIG. 2A is a side view of an alternate embodiment of the collar of the present invention, with the wing nut installed.
Figure 3:
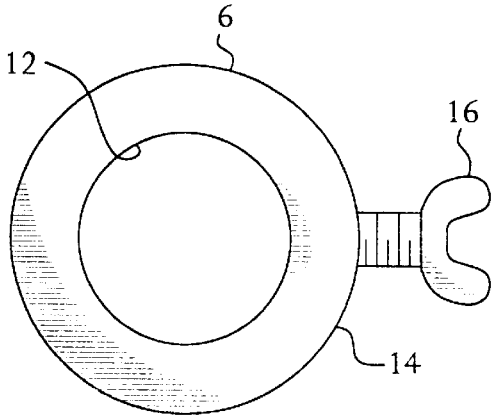
FIG. 3 is a top view of the collar of the present invention with the wing nut installed.

Stringline system 2 comprises marking rods or stakes 4 and collars 6, interconnected by stringline 8, located over and adjacent to roadway surface 10. It is anticipated that string, twine, wire, tubing, or other commonly employed construction line material can be used for the stringline of the present invention.

Each collar 6 of the present system is shown as being circular in configuration. This shape has been found to be optimal; however, any comparable shape can be used. Each collar 6 has an internal surface 12 and external surface 14. Collar 6 is slidably mounted for vertical movement up and down rod 4, along internal surface 12 of the collar, which substantially encircles and is in contact with the external surface of rod 4. Wing nut 16 extends through collar 6 and can be tightened or loosened to adjust the position of collar 6 on the rod as desired.

Dual grooves 18 and 20 are located on the exterior surface 14 of collar 6. Grooves 18 and 20 substantially encircle exterior surface 14. In an alternate embodiment of the invention, transverse grooves 22 and 24 interconnect grooves 18 and 20.

Figure 4:
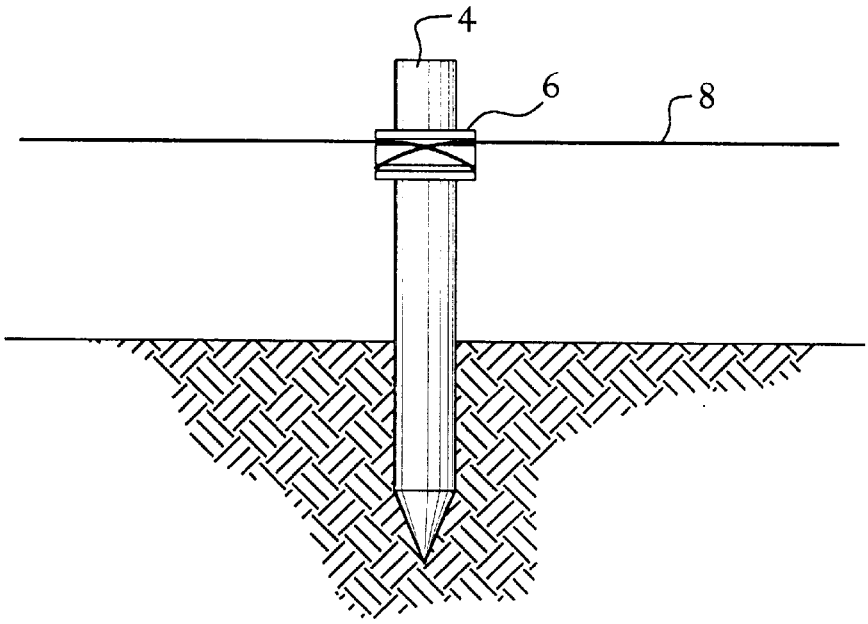
FIG. 4 is an elevation view of the collar and rod of the present invention in use.
Figure 5:
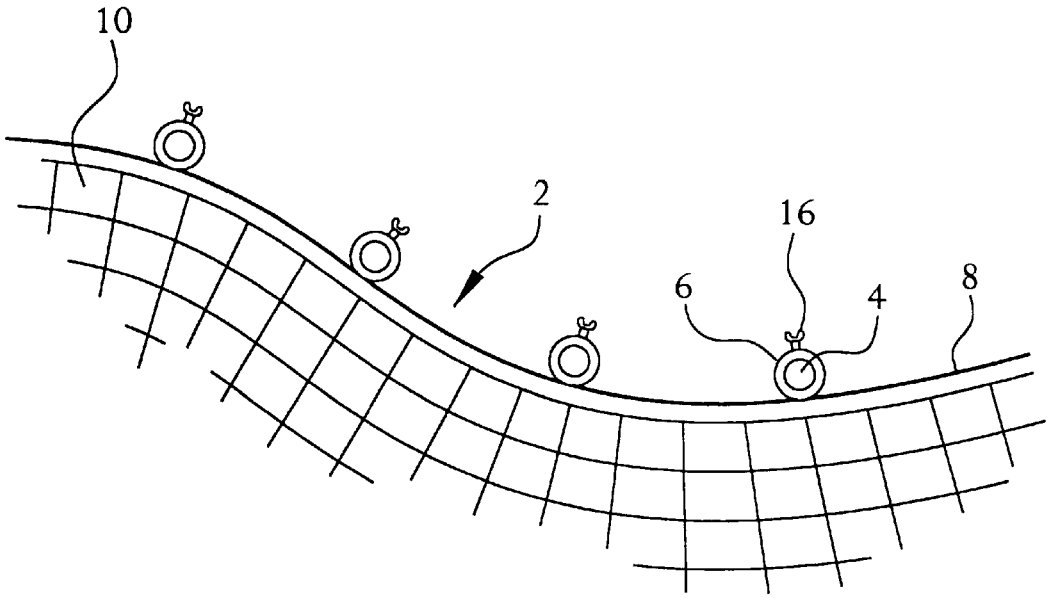
FIG. 5 is a top view of the stringline guide system of the present invention in use.

It thus can be appreciated that stringline 8 is positioned within grooves 18 and 20, before it proceeds to the next rod and collar, as seen in FIGS. 4 and 5. In the alternative embodiment, stringline 8 can run through interconnecting grooves 22 and 24, for added control of the stringline with the collar 6.

When a stringline 8 is used which has an external diameter which approximates the width of grooves 18, 20, 22 and 24, and the stringline is made of compressible material, the stringline can be compressed within the grooves to further maintain it in position.

It is contemplated that, for optimal operation and manufacturing purposes, the internal diameter of collar 6 will be one inch and have a vertical height of one inch. It is also anticipated that grooves 18, 20, and 22 and 24, when used, will be one-eighth inch deep and one-eighth inch wide. However, these dimensions are merely for exemplary purposes and do not so narrowly limit the scope of the invention. The collar can be manufactured of dimensions of convenient size.

In operation, when multiple rods are placed along the length of construction roadway surfaces, collars 6 are set on rods 4, with stringline 8 running between collars 6. The heights of the collars can then easily be adjusted up and down on the rods, as surface situations dictate.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed is:

1. An attachment device for a stringline guide system comprising a plurality of marking rods supporting a stringline, said attachment device comprising:

(a) collar means adjustably mounted for movement along a marking rod, said collar means having an external surface and an internal surface which substantially encircles the marking rod;

(b) means to manually adjust the position of the collar means on the marking rod; and (c) stringline receiving means substantially encircling the exterior surface of the collar in order to accept and maintain a stringline in position on the rod, said stringline receiving means comprising dual grooves which substantially encircle the exterior surface of the collar and transverse groove means interconnecting the dual grooves.

2. An attachment device for a stringline guide system as in claim 1 in which are configured to maintain the stringline in compression.

3. An attachment device for a stringline guide system as in claim 1 comprising a plurality of collar means on a plurality of marking rods.

4. An attachment device for a stringline guide system comprising a plurality of marking rods supporting a stringline, said attachment device comprising:

(a) collar means adjustably mounted for movement along a marking rod, said collar means having an external surface and an internal surface which substantially encircles the marking rod;

(b) means to manually adjust the position of the collar means on the marking rods; and (c) groove means inset from the exterior surface of the collar means to accept and maintain a stringline in position on the rod, said groove means comprising dual grooves which substantially encircle the exterior surface of the collar means and transverse groove means interconnecting the dual grooves.

5. An attachment device for a stringline guide system as in claim 4 in which are configured to maintain the stringline in compression.

6. An attachment device for a stringline guide system as in claim 4 comprising a plurality of collar means and a plurality of marking rods.

* * * * *